US007925371B2

(12) United States Patent
Takeichi

(10) Patent No.: US 7,925,371 B2
(45) Date of Patent: Apr. 12, 2011

(54) EYEGLASS LENS PROCESSING SYSTEM

(75) Inventor: Kyoji Takeichi, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 602 days.

(21) Appl. No.: 11/947,183

(22) Filed: Nov. 29, 2007

(65) Prior Publication Data

US 2008/0132147 A1 Jun. 5, 2008

(30) Foreign Application Priority Data

Nov. 30, 2006 (JP) ..... 2006-325073

(51) Int. Cl.
*G06F 19/00* (2006.01)
*H04Q 5/22* (2006.01)
*B23B 51/08* (2006.01)

(52) U.S. Cl. ..... 700/160; 340/10.1; 408/22

(58) Field of Classification Search ..... 340/10.1, 340/10.4, 572.8; 700/160
See application file for complete search history.

(56) References Cited

U.S. PATENT DOCUMENTS

| | | | | |
|---|---|---|---|---|
| 5,926,247 | A * | 7/1999 | Kimura | 351/41 |
| 6,283,826 | B1 | 9/2001 | Mizuno | |
| 6,790,124 | B2 | 9/2004 | Shibata | |
| 6,798,501 | B1 | 9/2004 | Mizuno | |
| 7,448,938 | B2 * | 11/2008 | Inoguchi | 451/5 |
| 7,563,153 | B2 * | 7/2009 | Haddadi | 451/8 |
| 2002/0167099 | A1 * | 11/2002 | Foreman et al. | 264/1.38 |
| 2005/0046792 | A1 * | 3/2005 | Ito et al. | 351/177 |
| 2005/0199716 | A1 * | 9/2005 | Shafer et al. | 235/385 |
| 2005/0242959 | A1 * | 11/2005 | Watanabe | 340/572.7 |
| 2009/0067940 | A1 * | 3/2009 | Arai et al. | 408/22 |

FOREIGN PATENT DOCUMENTS

| | | | |
|---|---|---|---|
| EP | 0 899 059 | A2 | 3/1999 |
| JP | 2-198749 | A | 8/1990 |
| JP | 8-252754 | A | 10/1996 |

OTHER PUBLICATIONS

Extended European Search Report dated Feb. 29, 2008.

* cited by examiner

*Primary Examiner* — Albert Decady
*Assistant Examiner* — Darrin Dunn
(74) *Attorney, Agent, or Firm* — Sughrue Mion, PLLC

(57) ABSTRACT

An eyeglass lens processing system for processing an eyeglass lens includes: a data inputting device that inputs a left and right target lens shape data and a layout data; a cup attaching device that attaches a lens fixing cup used for processing the eyeglass lens, the cup including an IC tag capable of rewriting data, the cup attaching device including a left/right information inputting unit that inputs which of left and right eyeglass lenses the attached eyeglass lens is, and a writing device that writes processing information including the left/right identifying information to the IC tag; and an eyeglass lens processing device that holds the eyeglass lens and processes the lens, the eyeglass lens processing device including a reading device that reads the information stored to the IC tag and a setting unit that sets the processing information based on the read left/right identifying information.

9 Claims, 7 Drawing Sheets

EYEGLASS LENS PROCESSING SYSTEM

BACKGROUND OF THE INVENTION

The present invention relates to an eyeglass lens processing system for processing a peripheral edge of an eyeglass lens.

According to an eyeglass lens processing device, a lens held by a lens chuck is roughly processed by a roughening grindstone. Thereafter, the lens is finished to process by a finishing grindstone (refer to, for example, U.S. Pat. No. 6,283,826 (JP-A-11-333684)). When the lens is held by the lens chick, a base portion of a cup fixed to a surface of the lens is mounted to a cup holder provided to the lens chuck, another chuck is moved to a side of the lens to hold the lens. Further, the cup is attached to an optical center of the lens or a geometrical center of a target lens shape by a cup attaching device (refer to, for example, U.S. Pat. No. 6,798,501 (JP-A-2001-62688)). The cup attaching device is also referred to as a blocker.

Meanwhile, in processing the lens, when powers (spherical power, cylindrical power, astigmatism axis (axial angle)) of left and right lenses differ from each other, it is important to process the lenses without mistaking the left and the right lenses. Therefore, an operator (processor) pays close attention so as not to mistake the left and right lenses. In correspondence therewith, marks, characters or the like for identifying the left and right lenses are marked on surfaces of the lenses by a pen or the like. Further, there is also proposed a cup capable of identifying left and right lenses by a cup having a difference in presence/absence of forming a recess portion or a hole at a base portion of the cup (refer to, for example, JP-A-8-252754).

However, according to the method of marking the marks or the like by the pen on the surfaces of the lenses, an operation of marking a mark and an operation of erasing the mark are needed. The operations take time and labor for the operator. Further, in a case of a lens coated by a water-repellant coating, a mark cannot be attached thereto.

The method of identifying the lenses by forming the recess portion or the hole at the base portion of the cup, shapes of the left and right cups cannot significantly be changed. Therefore, the recess portion or the hole is small, and therefore, the identification is not facilitated at a glance.

SUMMARY OF THE INVENTION

It is a technical problem of the invention to provide an eyeglass lens processing system capable of further reducing a mistake of left and right glasses.

In order to resolve the above-described problem, the invention is characterized in including the following constitution.

(1) An eyeglass lens processing system for processing a peripheral edge of an eyeglass lens, the system comprising:

a data inputting device that inputs a left and right target lens shape data and a layout data;

a cup attaching device that attaches a lens fixing cup used for processing the eyeglass lens, the cup including an IC tag capable of rewriting data, the cup attaching device including a left/right information inputting unit that inputs which of left and right eyeglass lenses the attached eyeglass lens is, and a writing device that writes processing information including the left/right identifying information to the IC tag; and an eyeglass lens processing device that holds the eyeglass lens by a lens chuck and processes the peripheral edge of the lens, the eyeglass lens processing device including a reading device that reads the information stored to the IC tag and a setting unit that sets the processing information based on the read left/right identifying information.

(2) The eyeglass lens processing system according to (1), wherein the processing information written to the IC tag by the writing device includes the left/right identifying information and an operation number.

(3) The eyeglass lens processing system according to (1), wherein the processing information written to the IC tag by the writing device includes the left/right identifying information and an operation number, and the reading device of the eyeglass lens processing device reads the left and right target lens shape data and the layout data inputted by the data inputting device based on the operation number.

(4) The eyeglass lens processing system according to (1), wherein the processing information written to the IC tag by the writing device includes the left and right identifying information and the target lens shape data and the layout data.

(5) The eyeglass lens processing system according to (1), wherein the cup attaching device outputs an instruction signal of writing data based on a switch signal for carrying out blocking of attaching the cup.

(6) The eyeglass lens processing system according to (1), wherein the cup attaching device further includes a reading device that reads a data of the IC tag, and includes a confirming unit that confirms whether a data written to the IC tag by the writing device and the data of the IC tag read by the reading device coincide with each other.

(7) The eyeglass lens processing system according to (6), wherein the cup attaching device outputs a signal of prohibiting a blocking operation when the data written to the IC tag and the read data of the IC tag are not confirmed to coincide with each other by the confirming unit.

(8) The eyeglass lens processing system according to (1), wherein the IC tag is shielded to be embedded in a base portion of the lens fixing cup.

(9) An eyeglass lens processing system for processing a peripheral edge of an eyeglass lens, the eyeglass lens processing system comprising:

a data inputting device that inputs a left and right target lens shape data and a layout data;

a cup attaching device that attaches a lens fixing cup used for processing the eyeglass lens, the cup including an IC tag attached with left or right identifying information optically recognizable by an operator and stored with left or right identifying information in correspondence with the identifying information; and an eyeglass lens processing device that holds the eyeglass lens by a lens chuck and processes the peripheral edge of the lens, the eyeglass lens processing device including a reading device that reads information stored to the IC tag, and a setting unit that sets left or right processing information based on the read left or right identifying information, or displays the left or right identifying information on a display.

DESCRIPTION OF THE PREFERRED EMBODIMENTS

Figure 1:
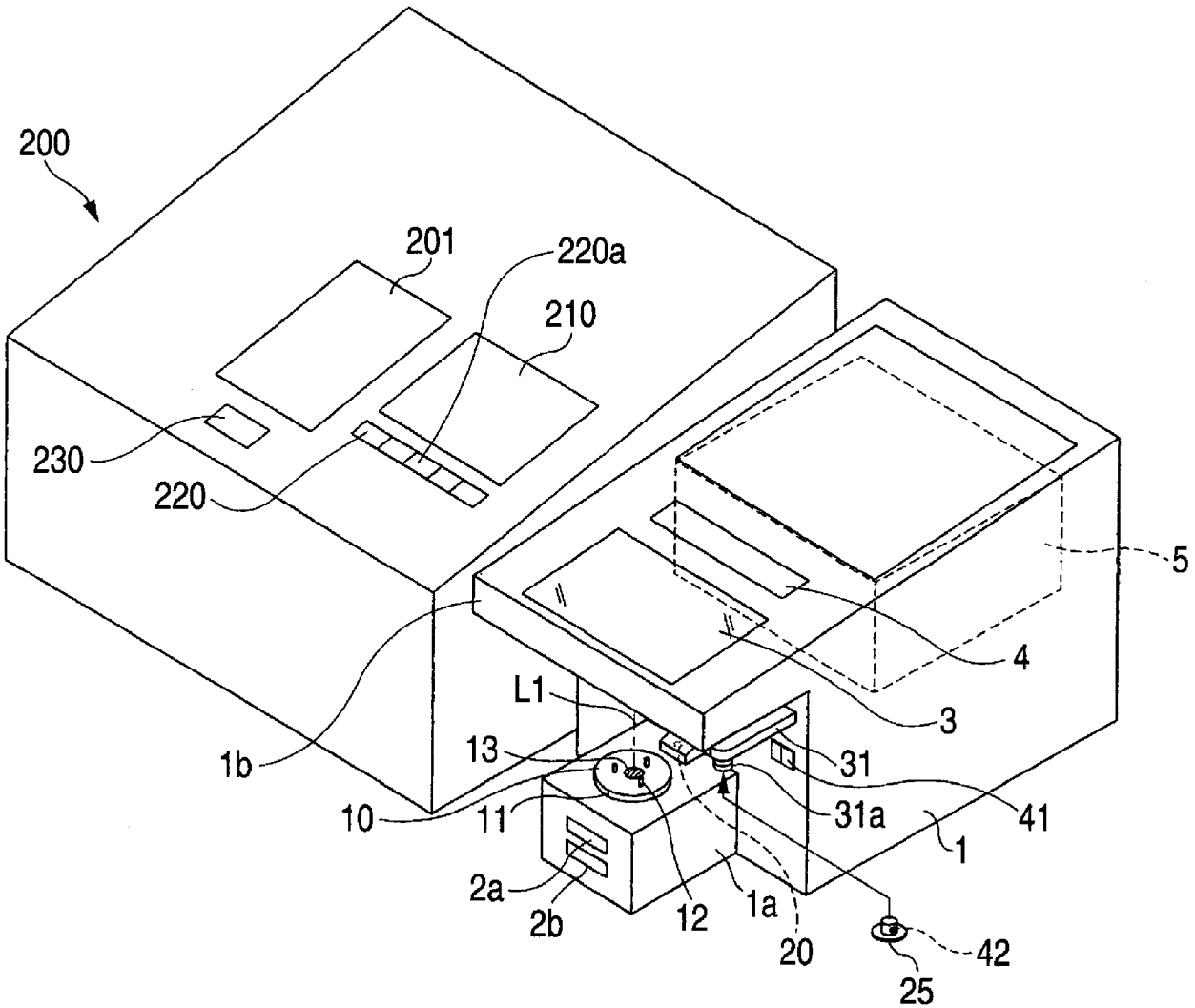
FIG. 1 is a view showing an eyeglass lens processing system according to the invention.

Embodiments of the invention will be explained in reference to the drawings as follows. FIG. 1 is an outline view of a processing system including a cup attaching device (blocker) and an eyeglass lens processing device according to the invention.

<Cup Attaching Device>

Figure 2:
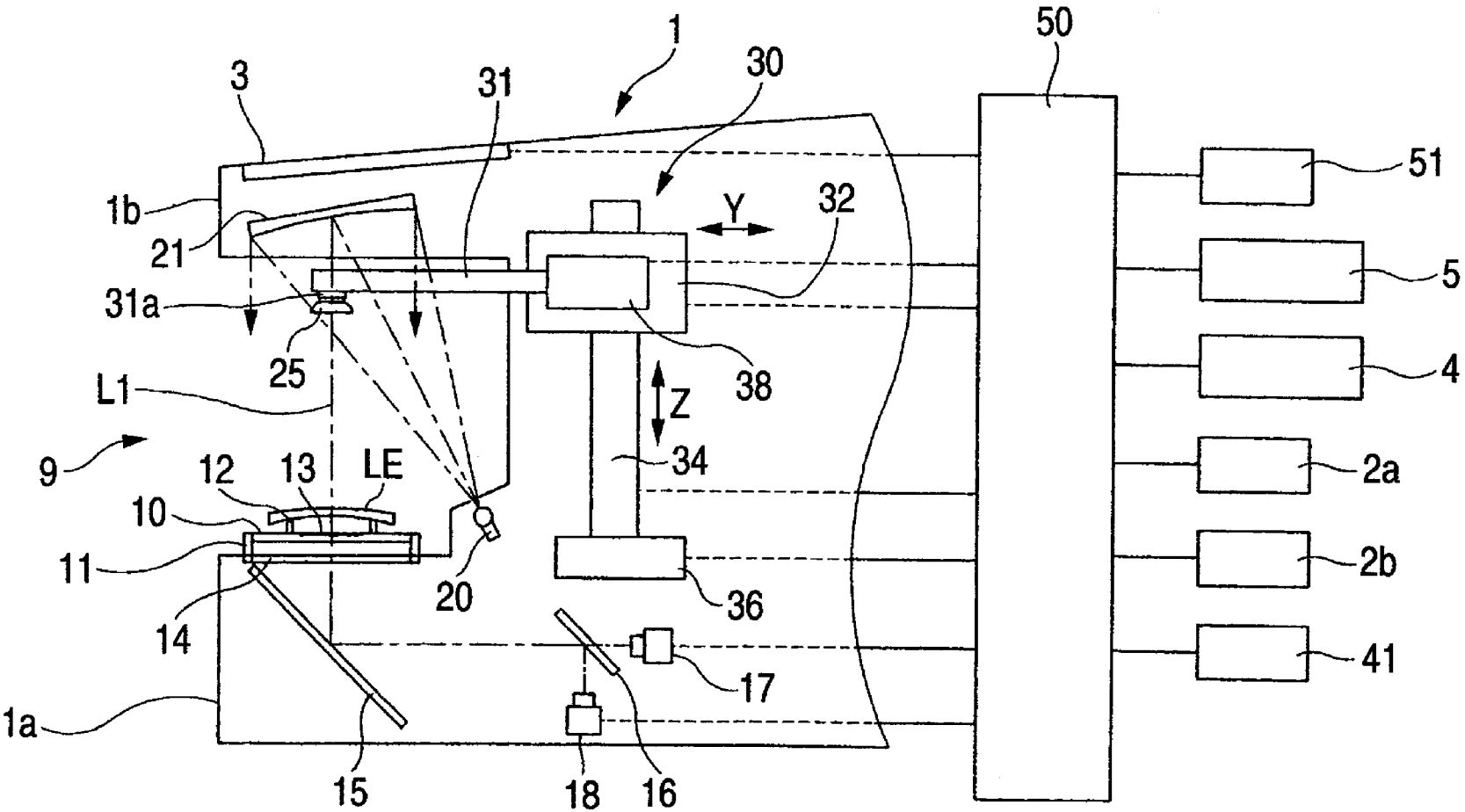
FIG. 2 is a view showing an outline of a cup attaching device.

A constitution of a cup attaching device 1 will be explained in reference to FIG. 1 and FIG. 2. FIG. 2 is a view showing outlines of an optical system, a blocking mechanism portion and a control system arranged at the device 1.

An upper face of a base 1*a* of a lower portion of the cup attaching device 1 projected to a front side is attached with a circular lens table 10 comprising transparent acrylic resin. The lens table 10 is mounted with a lens LE to be processed. 3 pieces of support pins 12 for supporting the processed lens LE are provided above the lens table 10 at equal intervals centering on a reference axis L1 for attaching a cup.

A front face of this side of the base 1*a* is arranged with a switch 2*a* for operating a blocking mechanism portion 30 (mentioned later). Further, the front face is arranged with a switch 2*b* for selecting left and right lenses. A pertinent space is ensured between a lower face of an upper portion 1*b* projected to a front side of the device 1 and the base 1*a*. The space is for the operator to hold the lens LE by the hand to move above the lens table 10 and for a cup 25 attached to a front end of a cup attaching arm 31 to be able to move up and down.

The device 1 is provided with a detection optical system 9 for detecting an optical center and an astigmatism axial angle of the lens LE by illuminating the lens LE placed on the table 10.

An illumination light source 20 is arranged at a rear vicinity of the lens table 10. A concave mirror 21 arranged at the projected upper portion 1*b* is provided with a mirror curved face for shaping illuminating light from the illumination light source 20 into a substantially parallel light flux having a diameter one size larger than that of the lens LE. Further, the concave mirror 21 is arranged such that an illuminating light flux made to be substantially parallel is projected along the reference axis L1 of the detection optical system 9.

A center of the lens table 10 is formed with an index portion 13 having a predetermined pattern centering on the reference axis L1. The index portion 13 comprises dot indexes arranged in a lattice-like shape. The dot indexes having a size of a diameter of 0.3 mm are arranged at a pitch interval of 0.3 mm in a range of 20 mm square centering on the reference axis L1 of attaching a cup. A lower side of the lens table 10 is arranged with a screen plate 14 made by a semitransparent material of frosted glass or the like. A light flux transmitting through the lens LE illuminates the index portion 13 on the lens table 10. A total image of the lens LE and a dot index image subjected to prism operation of the lens LE are projected onto the screen plate 14. A mirror 15 is arranged on a lower side of the screen plate 14, and a first CCD camera 17 is provided in a reflecting direction of the mirror 15. The first CCD camera 17 is provided with a lens for taking an image by enlarging only a center region centering on the reference axis L1 to be able to detect the index image projected to the screen plate 14. A half mirror 16 is arranged on an optical path between the mirror 15 and the first CCD camera 17 and a second CCD camera 18 is provided in a reflecting direction thereof. The second CCD camera 18 is provided with a lens for taking the total image of the lens LE projected onto the screen plate 14.

A brief explanation will be given of a method of calculating a position of the optical center and a direction of an astigmatism axis from the image of the dot index image provided by the first CCD camera 17. When the lens LE is not mounted, the dot index of the index portion 13 is illuminated by a parallel light flux, and therefore, a position of a dot image disposed right below a vicinity of the optical center of the lens LE stays the same regardless of presence or absence of the lens LE. On the other hand, a coordinate position of a dot image of a portion which does not constitute the optical center is moved by the prism operation of the lens LE. Therefore, in order to detect the optical center, there is calculated a change in the coordinate position of each dot image in a state of being mounted with the lens LE relative to the coordinate position of each dot image in a state without the lens LE. Furthermore, it is calculated to which position each dot image is diverged or converged centering thereon. That is, the center of diverging or converging constitutes the optical center.

Further, when the lens LE is provided with an astigmatism degree, each dot image is moved in a direction of being proximate to (or a direction of being remote from) a generatrix of the lens. Therefore, the astigmatism axis direction is detected by investigating in which direction each dot image is moved relative to the coordinate position of each dot image in the state of absence of the lens LE.

In FIG. 2, the blocking mechanism portion 30 includes the arm 31 arranged with a cup holder 31*a* mounted with a base portion of the cup 25, a Y axis direction moving unit 32 for moving the arm 31 in Y axis direction shown in FIG. 2, a Z axis direction moving unit 34 for moving the arm 31 in an up and down direction (Z axis direction) along with the Y axis direction moving unit 32, and an X axis direction moving unit 36 for moving the arm 31 in a left and right direction (X axis direction) relative to the device 1 along with the Z axis direction moving unit 34. The moving units 32, 34, 36 can be constituted by well-known moving mechanisms respectively having slide mechanisms and motors. The cup holder 31*a* is attached to the arm 31 rotatably centering on an axis extended in the up and down direction. The Y axis direction moving unit 32 is arranged with a drive unit 38 arranged with a motor for rotating the cup holder 31*a*, and a drive force of rotation by the drive unit 38 is transmitted to the cup holder 31*a* by a rotation transmitting mechanism (constituted by a gear, a rotating shaft and the like) arranged at inside of the arm 31. By rotating the cup holder 31*a* centering on the up and down shaft, an angle of fixing the cup 25 is adjusted in accordance with an astigmatism viewing angle of the lens LE.

A vicinity of the cup holder 31*a* provided by the arm 31 placed at an escape position is arranged with a writing/reading unit 41 having a function of writing and storing information to an IC tag 42 (refer to FIG. 5A) included in the cup 25 and a function of reading written information. The example of FIG. 1, the writing/reading unit 41 is arranged at a lower portion of the arm 31 placed at the escape position. In the writing/reading unit 41 is provided with an antenna for transmitting and receiving a radio wave for wireless communication for writing and reading information to and from the IC tag 42.

An intensity of the radio wave of writing and reading by the writing/reading unit 41 is set to fall in a range in which the cup holder 31*a* is placed at the escape position. Thereby, it can be prevented that data is erroneously written to the IC tag 42 of the cup 25 disposed at a position remote from the cup holder 31*a*. Further, the antenna provided to the writing/reading unit 41 may be provided at the cup holder 31*a*. Thereby, communication of information to the IC tag 42 included in the cup 25 in a state of being mounted with the cup holder 31*a* can further firmly be carried out.

Further, although the writing/reading unit 41 may be constituted only by the writing unit, it is preferable to construct a constitution simultaneously provided with the reading function as in the embodiment in order to confirm whether information written to the IC tag 42 is pertinent.

An eyeglass frame shape measuring unit 5 is arranged on a rear side of the device 1. An upper face of the device 1 is arranged with a color liquid crystal display 3 for displaying a lens image taken by the second CCD camera 18 or various information, and an operating switch portion 4 of the eyeglass frame shape measuring unit 5. The display 3 is provided with a touch panel function.

The eyeglass frame shape measuring unit 5, the display 3, the CCD cameras 17, 18 of the detection optical system, the moving units 32, 34, 36 of the blocking mechanism portion 30, the writing/reading unit 41, a memory 51 and the like are connected to a control portion 50. The control portion 50 calculates an optical center position and an astigmatism axis direction of the lens LE based on an output signal from the CCD camera 17. Further, the control portion 50 controls to drive the respective units and display by the display 3. Further, a data inputting device for inputting data of target lens shape data and layout data or the like is constituted to serve also as the display 3, the control portion 50, the memory 51 and the like. The data inputting device may be integral with the cup attaching device 1 or may be constructed by a constitution of being connected to an operating device 200 to be able to transmit data.

<Eyeglass Lens Processing Device>

Figure 3:
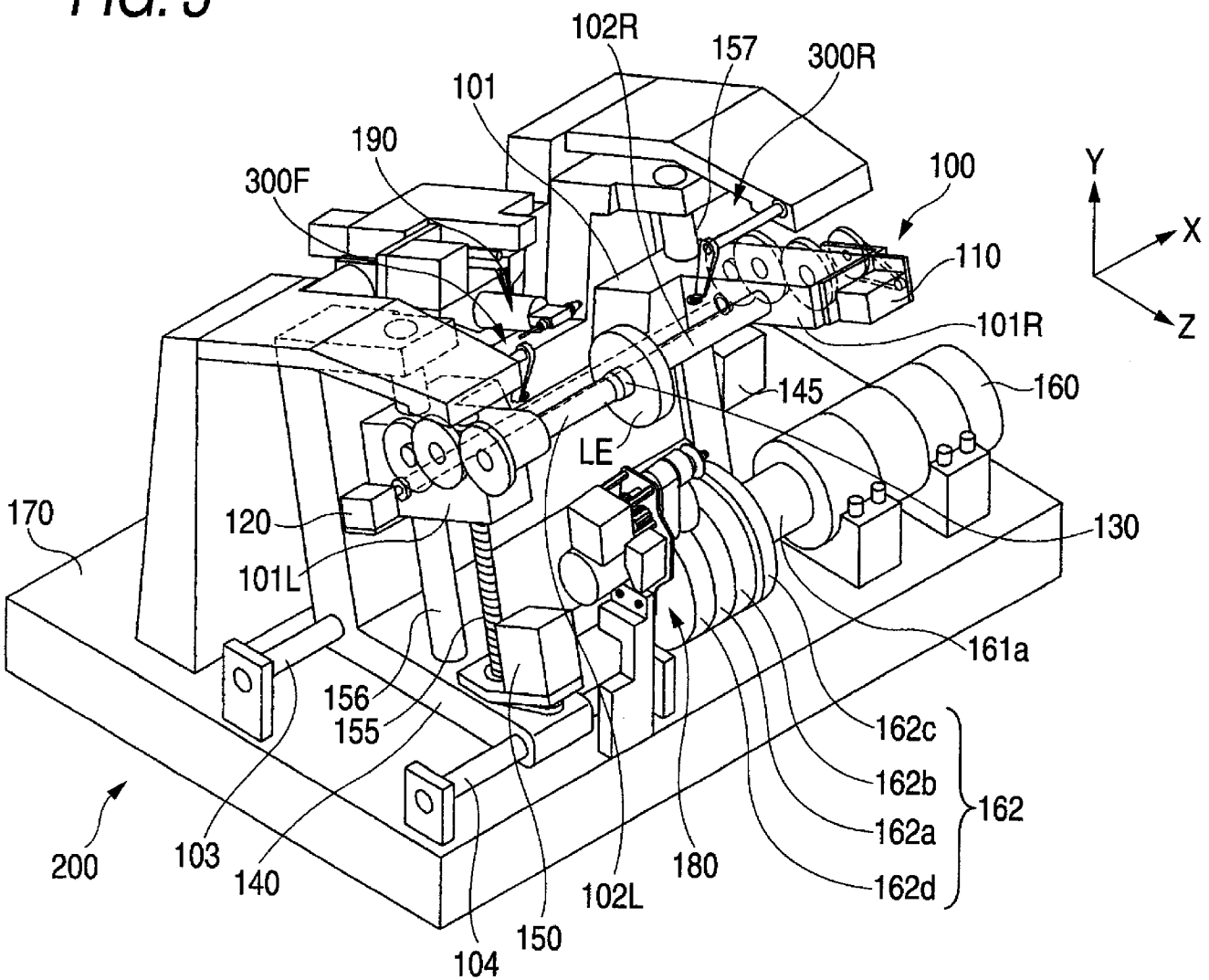
FIG. 3 is a view showing an outline of a processing mechanism of an eyeglass lens processing device.

A constitution of the eyeglass lens processing device 200 will be explained in reference to FIG. 1 and FIG. 3. FIG. 3 is an outline constitution view of a processing mechanism at inside of the device.

A carriage portion 100 is mounted on a base 170. Further, the processed lens LE is pinched by lens chucks 102L, 102R provided to a carriage 101 constituting the carriage portion 100. A peripheral edge of the lens LE is processed by controlling distances of the chucks 102L, 102R relative to a grindstone group 162 attached to a grindstone spindle 161 and rotated by a motor 160. The grindstone group 162 is constituted by a roughening grindstone for plastic 162*a*, a bevel-finishing and plane-finishing grindstone 162*b* and a polishing-finishing grindstone 162*c*, a roughening grindstone for glass 162*d*.

The lens chuck shaft 102L is held by a left arm 101L of the carriage 101 and the lens chuck 102R is held by a right arm 101R respectively rotatably and coaxially. The lens chuck shaft 102R is moved to a side of the lens chuck 102L by a motor 110 attached to the right arm 101R. Further, the lens LE is held by two of the lens chucks 102R, 102L. Further, the two lens chucks 102R, 102L are rotated by a motor 120 attached to the left arm 101L by way of a rotation transmitting mechanism of a gear or the like in synchronism with each other. A front end side of the lens chuck shaft 102L is fixed with a cup holder 130 mounted with a base portion 25*a* of the cup 25. A front end side of the lens chuck 102R is fixed with a lens holding member 135 brought into contact with a back face of the lens LE (refer to FIG. 6B).

The carriage 101 is mounted on an X-axis moving support base 140 along shafts 103, 104 extended in parallel with the grindstone spindle 161. A back portion of the support base 140 is attached with a ball screw extended in parallel with the shaft 103 (not illustrated). The ball screw is attached to a rotating shaft of an X-axis moving motor 145. Further, the carriage 101 is moved in an X-axis direction along with the support base 140 by rotating the motor 145.

Further, the support base 140 is fixed with shafts 156, 157 extended in a Y-axis direction (a direction of varying distances between axes of the lens chucks 102R, 102L and the grindstone spindle 161). The carriage 101 is mounted on the support base 140 along the shafts 156, 157 movably in the Y-axis direction. The support base 140 is fixed with a Y-axis moving motor 150. Rotation of the motor 150 is transmitted to a ball screw 155 extended in the Y-axis direction. Further, the carriage 101 is moved in the Y-axis direction by rotating the ball screw 155.

In FIG. 3, this side of the processing device 200 is arranged with a chamfering mechanism portion 180. An upper side of the carriage 101 is provided with edge path position measuring portions (lens shape measuring portions) 300F, 300R. A back side of the carriage portion 100 is arranged with a boring and grooving mechanism portion 190. Well-known constitutions thereof are used. Therefore, an explanation thereof will be omitted here.

Further, an upper face of the processing device 200 is arranged with a color display 210 and an operation switch panel 220 having a touch panel function. An opening/closing door 201 is arranged at the upper face of the processing device 200. The upper face of the processing device 200 is further arranged with a reading unit 230 for reading information written (stored) to the IC tag 42 provided to the cup 25. The reading unit 230 is provided with an antenna for transmitting and receiving a radio wave for wireless communication for reading the information of the IC tag 42.

Further, the reading unit 230 may be arranged at inside or a vicinity of a cup holder 130 provided to the lens chuck 102L. In this case, when the cup 25 is mounted to the cup holder 130, a data is read and time and labor of an operator is simplified. When a size of the reading unit 230 is large, only the antenna separated from a main body of the reading unit may be arranged at the cup holder 130 or a vicinity thereof.

Figure 4:
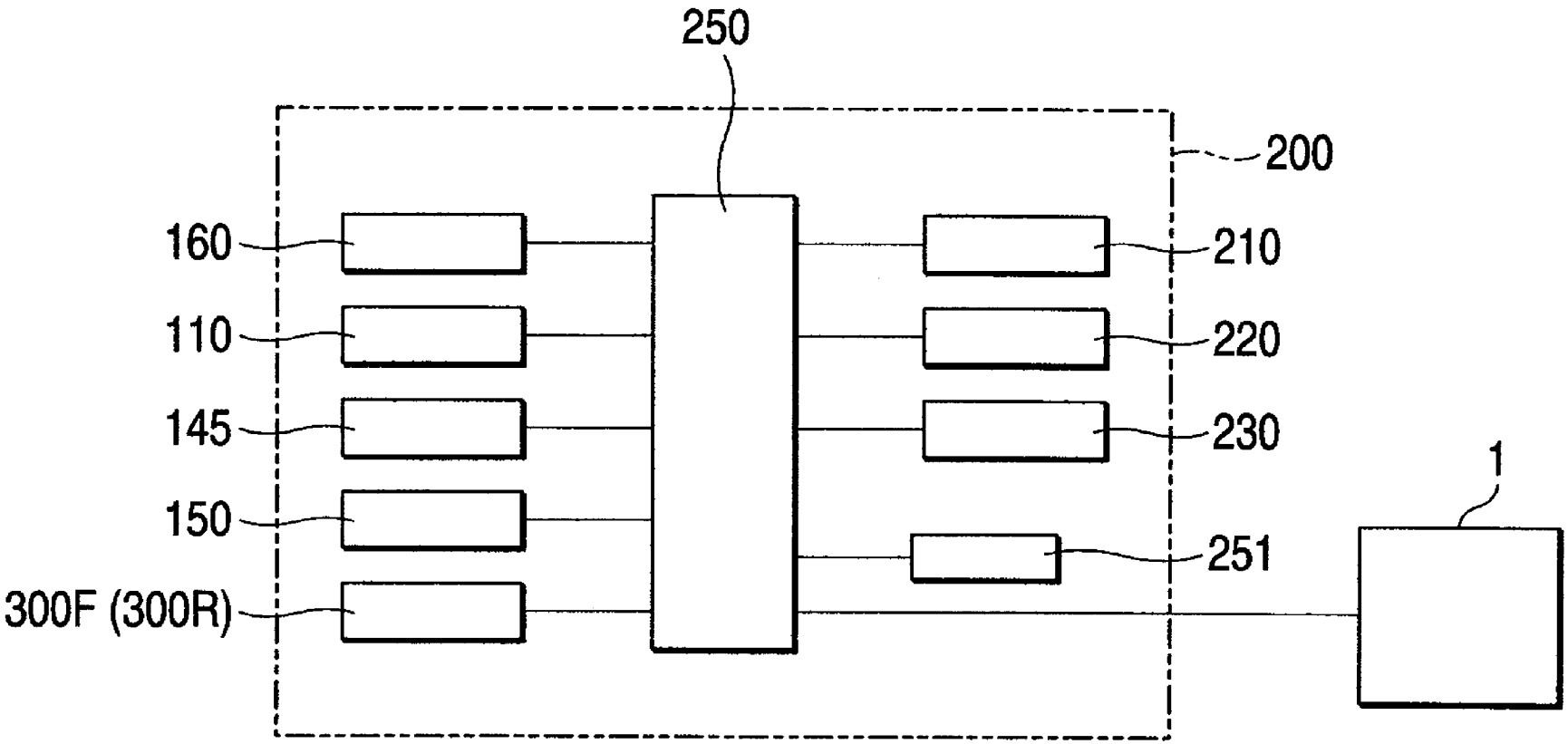
FIG. 4 is a block diagram showing a control system of an eyeglass lens processing device.

FIG. 4 is a block diagram of a control system of the processing device 200. The display 210, the operating switch panel 220, the reading unit 230, respective motors of the carriage portion 100, the motor 160 for rotating the grindstone and the like are connected to the control portion 250. Further, the cup attaching device 1 is connected to the control portion 250 to transmit and receive data.

<Lens Fixing Cup>

Figure 5A:
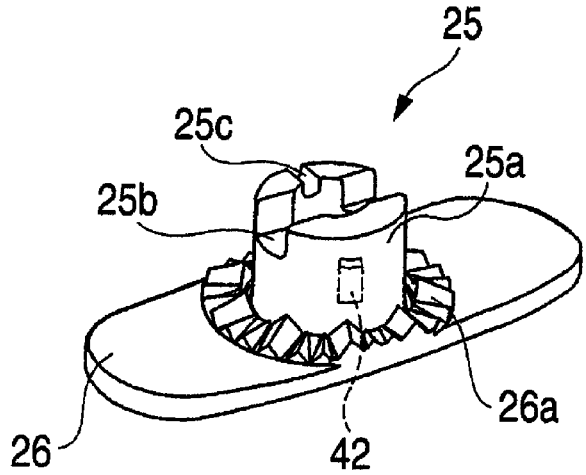
FIG. 5A through FIG. 5B are views for explaining a cup.
Figure 5B:
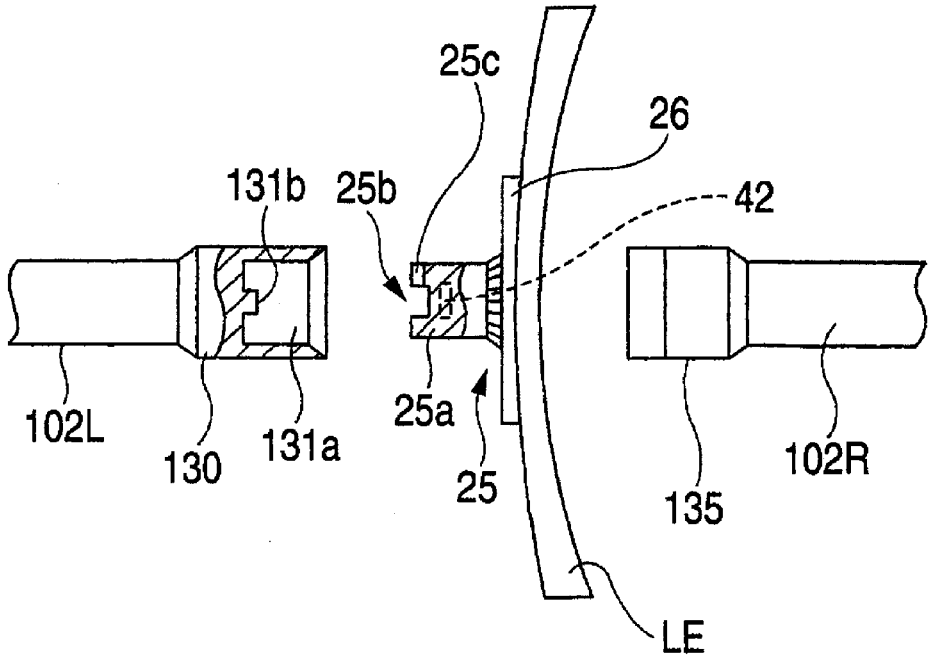

FIG. 5A and FIG. 5B are views for explaining the cup 25 as a fixing jig fixed to a surface of the lens LE.

FIG. 5A is a perspective view of the cup 25. FIG. 5B is an explanatory view of a constitution of the cup holder 130 provided to the lens chuck 102L when the lens LE is held.

The cup 25 is used commonly to a lens for the right eye and a lens for the left eye. The cup 25 is provided with the base portion 25*a* inserted to an inserting hole 131*a* of the cup holder 130, and a flange portion 26. The base portion 25*a* and the flange portion 26 are integrally molded by resin. The base portion 25*a* is formed with a key groove 25*b*. By fitting the key groove 25*b* to a key 131*b* formed at the inserting hole 131*a* of the cup holder 130, the lens LE can be held by bringing an astigmatism axis angle of the lens LE and an angle for rotating the lens chuck 102L (102R) into a constant relationship. Further, the base 25*a* is formed with a notch 25*c* for determining a position in an up and down direction of the lens. Further, the flange portion 26 is formed with a recessed and projected portion 26*a* around the base portion 25*a* for positioning to the cup holder 130 to reduce a rotational shift.

Also an end portion of the cup holder 130 is formed with a recessed and projected portion fitted to the recessed and projected portion 26*a*.

Further, an inner side of the base portion 25*a* is embedded with the rewritable IC tag 42. The IC tag 42 is provided with an IC chip and an antenna for writing and reading data of the IC chip by being started by receiving a radio wave from the writing/reading unit 41 and the reading unit 230 by the antenna and an IC tag on sale of a size of several millimeters can be used. In attaching the IC tag 42 to the base portion 25*a*, the IC tag 42 is embedded to a hole formed at the base portion 25*a* and embedded and shielded by capping by resin. Thereby, although grinding water is used at the processing device 200 in processing the lens, since the IC tag 42 is fixed to be shielded, the IC tag 42 is protected against grinding water. Further, the cup 25 is repeatedly used, and therefore, the cup 25 is easy to be stained by grinding water in processing or a processing tank, the IC tag 42 can transmit and receive a radio wave even the shield matter is present, and therefore, the IC tag 42 is convenient for writing and reading data to and from an object utilizing light as in a bar code.

Further, it is preferable to arrange the IC tag 42 to be disposed at a position which does not interfere with holding of the cup 25 when the base portion 25*a* is inserted to the cup holder 31*a* on a side of the cup attaching device 1 and the cup holder 130 on a side of the eyeglass lens processing device 200. Further, the flange portion 26 is easy to be deformed when the flange portion 26 is attached to the surface of the lens, and therefore, it is preferable to arrange the IC tag 42 at a position avoiding the flange portion 26.

After mounting the base portion 25*a* of the cup 25 fixed with the lens LE to the cup holder 130, by moving the lens chuck 102R to a side of the lens, the lens hold member 135 is brought into contact with the rear face of the lens, and the lens LE is held by two of the lens chucks 102R and 102L.

Further, also a structure of the cup holder 31*a* provided to the cup attaching device 1 is formed with an inserting hole and a key similar to the cup holder 130. Shapes thereof are similar to those of the cup holder 130, and therefore, an explanation thereof will be omitted.

Next, an explanation will be given of operations of the cup attaching device 1 and the processing device 200 using the cup 25 as described above. First, an explanation will be given of an operation of fixing the cups 25 respectively to left and right lenses by the cup attaching device 1.

Figure 6:
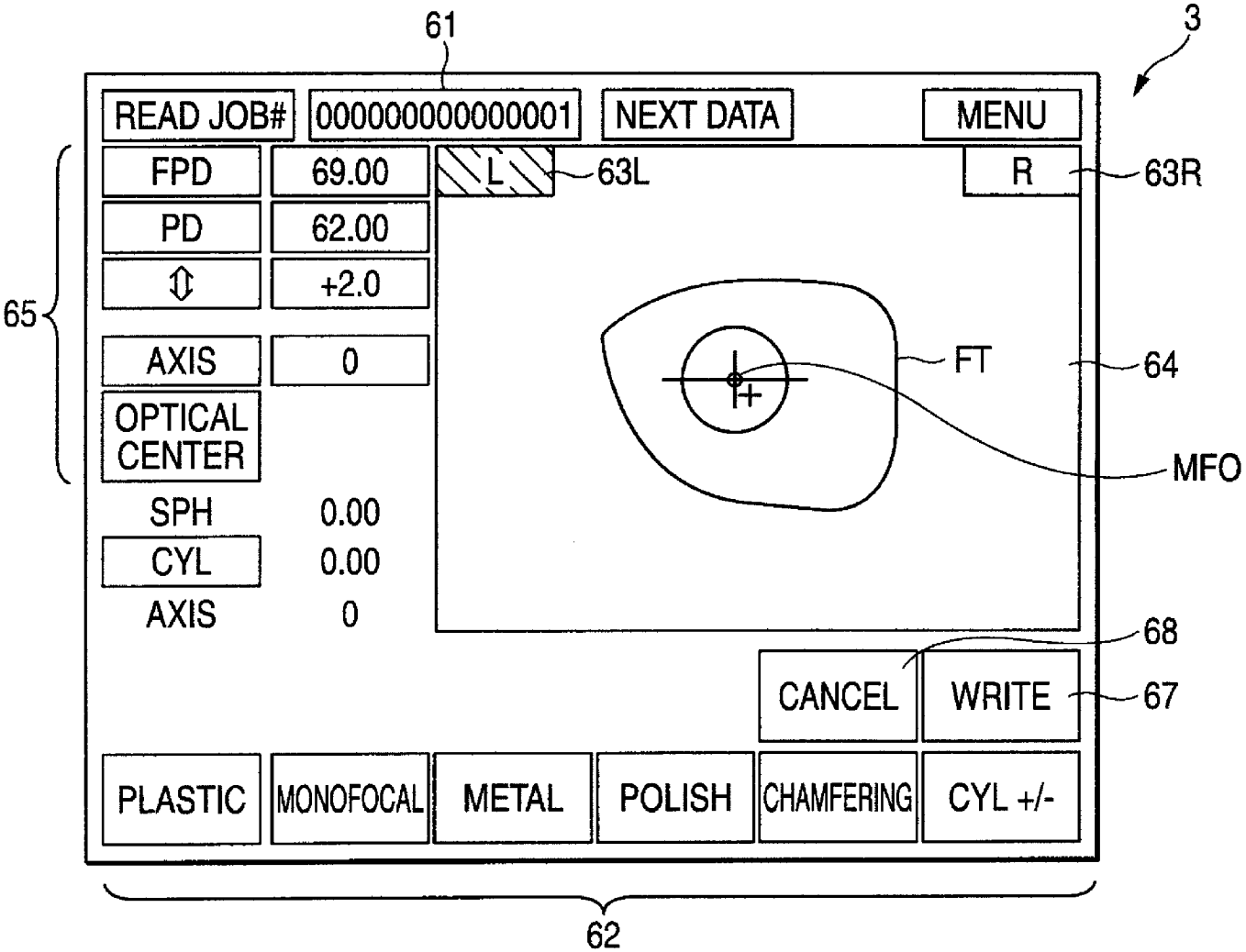
FIG. 6 is a view for explaining an input screen of a cup attaching device.

Shapes of left and right lens frames of an eyeglass frame are measured by the eyeglass frame shape measuring unit 5. Measured eyeglass frame shape data is stored to the memory 51 by depressing a data transmitting key displayed on the display 3. An input screen as shown by FIG. 6 is displayed on a screen of the display 3. The screen displays that it is necessary to input an operation number (operation code) for controlling a pair of left and right lenses LE, and therefore, an operator inputs an operation number by a numerical key pad displayed by depressing an operation number input column 61. Further, by operating respective keys of a processing condition selecting column 62 on the screen, processing conditions of a material of a lens, a kind of a lens (monofocal lens, bifocal lens or the like), a processing mode and the like can be inputted. Further, a layout data can be inputted by operating respective input keys of a layout input column 65. A target lens shape data, a processing condition and a layout data and the like are stored to the memory 51 in relation to the operation number. Further, left and right target lens shape data also includes a case in which by mirror-inverting a target lens shape data on one side of left and right sides, another side of target lens shape data is constituted.

Further, the operator selects which of left and right lenses the lens LE is by left and right selecting keys 63R, 63L. The left and right lenses can be selected also by the switch 2*b*. A result of selecting the left and right lenses is reported to the operator by netting to display a display area of the left and right selecting key 63R or 63L.

Inputting a layout data will be explained. The operator can input the layout data of FPD (frame pupillary distance), PD (pupillary distance), a height of an optical center of a lens relative to a geometrical center of the target lens shape and the like by depressing respective keys of the layout input column 65. The height of the optical center of the lens relative to the geometrical center of the target lens shape can be inputted separately for left and right lenses. Further, an astigmatism axis angle of a prescription data of the lens LE can be inputted and it can be selected whether a block center of the lens is an optical center or a frame center (geometrical center of a target lens shape).

Attaching the cup to the lens LE will be explained. For example, assume that the lens for the left eye is selected by the key 63L for attaching the cup 25 to the lens LE for the left eye. The operator mounts the cup 25 to the cup holder 31*a* and mounts the lens LE for the left eye to a vicinity of a center of the support pin 12. When the lens LE is mounted to a vicinity of the center of 3 pieces of the support pins 12, an index image projected to the screen plate 14 is taken by the first CCD camera 17, and the optical center and the astigmatism axis direction of the lens LE are detected by the control portion 50. A layout screen 64 is displayed with a target lens shape diagram FT, and displayed with an optical center mark MFO based on the detected optical center. Further, based on an inputted astigmatism axis angle and a detected astigmatism axis angle, a direction in a horizontal direction of the target lens shape diagram FT can be changed. By displaying the optical center and the astigmatism axis angle of the lens detected by the detection optical system 9, the operator can carry out an alignment by moving the lens LE by constituting a reference by a cup attaching center of the reference axis L1. According to the device of the embodiment, instead of moving the lens LE, the arm 31 of the blocking mechanism portion 30 is three-dimensionally moved and an axis angle of blocking is automatically changed by rotating the cup holder 31*a* by the control of the control portion 50.

Next, when the switch 2*a* of blocking for moving the arm 31 is depressed, a signal of the switch 2*a* is made to serve also as a data writing instruction signal to the IC tag 42, and an operation of writing data to the IC tag 42 is started. When the instruction signal from the switch 2*a* is inputted, the control portion 50 starts an operation of writing to the writing/reading unit 41 prior to starting of operation of blocking. The writing/reading unit 41 transmits information of identifying left or right of the lens LE selected by the left and right selecting keys 63R, 63L and information of the operation number inputted to the operation number input column 61 by way of the antenna. Thereby, the transmitted information is written (stored) to the IC tag 42 provided to the cup 25. Successively, an instruction signal of reading is transmitted from the writing/reading unit 41. Thereby, data stored to the IC tag 42 is transmitted to the writing/reading unit 41, and the data is read by the writing/reading unit 41. The control portion 50 confirms coincidence between a content of the data instructed to write and a content of the read data.

Here, when there is hazard in transmitting and receiving the data, the contents of the data are incoincident. In this case, the display 3 is displayed with an alarm message stating that there is an abnormality in writing data and a blocking operation of moving the arm 31 is prohibited. Thereby, it can be prevented that the cup 25 is attached to the lens while writing the data to the IC tag 42 stays to be abnormal.

When the alarm message is displayed, the operator can deal therewith of trying the instruction of transmitting the data by depressing the switch 2*a* again. Or, when the IC tag 42 is failed, the operator can deal therewith by interchanging the cup 25 by other cup.

In a case in which there is not an abnormality by confirming the coincidence between the content of data instructed to write and the content of the read data, the control portion 50 displays the case on the display 3 and thereafter moves the arm 31 by controlling the respective moving units of the blocking mechanism portion 30. The control portion 50 positions the center position of the cup holder 31*a* provided to the arm 31 to the optical center of the lens based on the optical center of the lens detected by the detection optical system 9 and the layout data. Further, the cup 25 is rotated along with the cup holder 31*a* based on the astigmatism axis angle detected by the detection optical system 9 and the inputted astigmatism axis angle. When the alignment position is determined, the control portion 50 moves down the arm 31. Thereby, the cup 25 is fixed to the surface of the lens LE.

Further, although in the above-described, the switch signal of the switch 2*a* of blocking is also made to serve as a writing instruction signal of the data to the IC tag 42, an exclusive writing instruction key 67 provided at the display 3 may be used. In a case in which there is an error in transmitting or receiving a radio wave, the case can be dealt with by temporarily detaching the cup 25 from the cup holder 31*a*, thereafter, holding the cup 25 over a vicinity of the writing/reading unit 41 and further confirming writing and reading of the data by using the writing instruction key 67.

Further, when the writing instruction key 67 is used for the instruction signal when the writing/reading unit 41 is operated without making the switch 2*a* serve therefor, oversight of writing the data can be prevented by constituting as follows. That is, when the instruction signal of the writing instruction key 67 is inputted, the control portion 50 operates the writing/reading unit 41 to write the data to the ID tag 42 by transmitting information of identifying left or right or the like, thereafter, make the writing/reading unit 41 read the data stored to the IC tag 42 to thereby confirm the coincidence with the written content. When the written content is coincident therewith, it is determined that writing data to the ID tag 42 is finished, and when the blocking instruction signal from the switch 2*a* is inputted, the blocking mechanism portion 30 is operated.

On the other hand, when the instruction signal of the writing instruction key 67 is not inputted and the blocking instruction signal from the switch 2*a* is inputted without confirming the stored content of the IC tag 42, the control portion 50 determines that writing the data to the ID tag 42 is not finished. Further, driving of the blocking mechanism portion 30 for moving the arm 31 is prohibited and an alarm message stating the prohibition is displayed on the display 3. Thereby, it can be prevented that the cup 25 is attached to the lens LE without writing the data to the IC tag 42.

Further, after finishing to write the data to the IC tag 42 by the instruction signal of the writing instruction key 67, a change in the written information (including also the case of writing the target lens shape data, the layout data or the like as described later) is prohibited by the control portion 50. That is, until finishing to attach the cup 25 by the blocking instruction signal from the switch 2*a*, designation of left or right lens by the left and right selecting key 63R or 63L and input of the operation number to the operation number input column 61 are prohibited. Further, when the keys are operated, an alarm message is displayed. When it is necessary to changed at a written to the IC tag 42, when the signal of erasing the data is inputted by depressing a cancel key 68 arranged at the display 3, the writing/reading unit 41 is driven by the control portion 50, and the data written to the IC tag 42 is erased. Thereby, prohibition of input of left or right selection and the operation number or the like is released.

Also in a case of attaching the cup 25 to the lens for the right eye, the case is carried out by a similar procedure. When the cup 25 is attached to the lens for the right eye, the operator selects the cup 25 for the right eye by the key 63R. Here, when the cup 25 is precedingly attached to the lens for the left eye, thereafter, the switch 2*a* or the writing instruction key 67 is inputted without the right selecting signal by the selecting key 63 for the right eye (stays to be the left selecting signal), the control portion 50 determines that left and right are duplicated based on the operation number controlled by the pair of left and right lenses, and prohibits operation of the blocking mechanism portion 30 of moving the arm 31 thereafter. Thereby, the cups 25 duplicated in left and right can be prevented from being attached by the same operation number.

In this way, differentiation of left and right is controlled for the pair of left and right lenses LE attached with the cups 25 by left and right identifying information stored to the IC tags 42 of the cups 25. Further, the lens themselves is controlled by the stored operation number.

Figure 7:
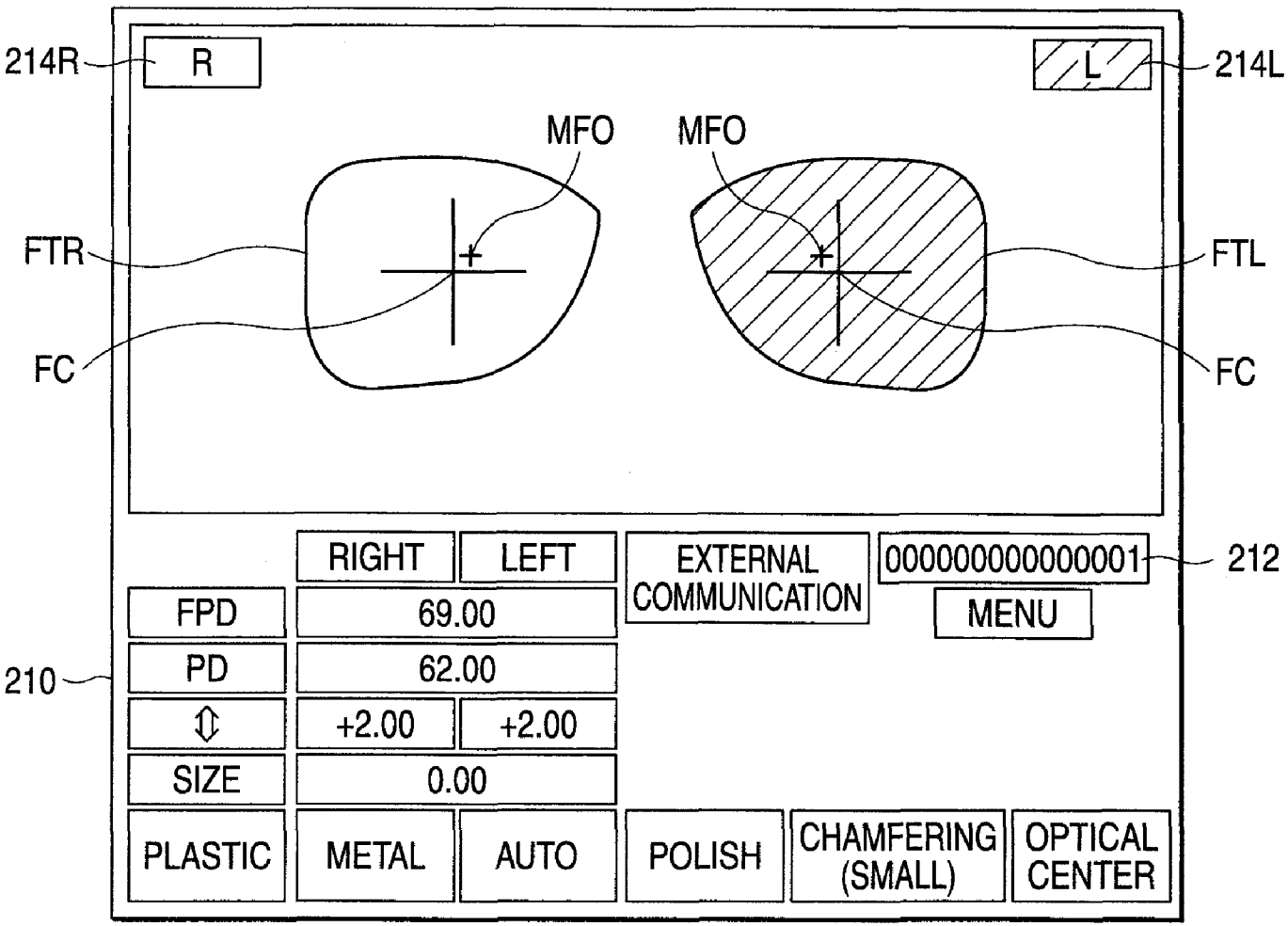
FIG. 7 is a view for explaining an input screen of an eyeglass lens processing device

Next, lens processing by the processing device 200 will be explained. FIG. 7 shows an example of a data input screen displayed on the display 210.

First, the operator holds the cup 25 fixed to the lens LE over the reading unit 230. Thereby, the data of the left or right identifying information and the operation number stored to the IC tag 42 provided to the cup 25 is read by the reading unit 230, the data is stored to the memory 251. The control portion 250 sets which of left and right the lens to be processed is based on the read left or right identifying information and a corresponding side of left or right display columns 214R, 214L of the display 210 is netted to be displayed. FIG. 7 shows an example of setting the lens for the left eye and the left or right display column 214L is netted to be displayed.

Further, when the operation number is read by the reading unit 230, the operation number is displayed by an operation number display column 212, by the control portion 250, data of the target lens shape data, the layout data, the set processing condition and the like in correspondence with the operation number are called from the memory 51 of the cup attaching device 1, and stored to the memory 251 on a side of the processing device 200. Respective display columns at a lower portion of the screen are set based on the called layout data and working condition data. Further, an upper portion of the screen is displayed with a target lens shape diagram FTR for the right eye and a target lens shape diagram FTL for the left eye and illustrated to be displayed with geometrical centers FC and optical centers MFO for the respective target lens shapes.

As described above, setting of left or right of the lens LE is automatically carried out by reading the left or right identifying information written to the IC tag 42 provided to the cup 25 by the reading unit 230 without being conscious of left or right of the lens LE fixed with the cup 25 for the operator. Thereby, mistake of left or right lens can be prevented when the lens is processed by the processing device 200. Further, when also the operation number is written to be stored to the IC tag 42, a failure in inputting the operation number which is carried out by the operator on the side of the processing device 200 can also be prevented.

In processing the lens LE, when the chuck switch 220*a* arranged at the operation switch panel 220 is depressed, the lens chuck 102R is moved to the lens side and the lens LE is chucked by the control of the control portion 250. Thereafter, when a processing start switch of the operation switch panel 220 is depressed, first, the shape of the lens LE is measured based on the target lens shape data. Successively, the respective motors of the carriage portion 100 are controlled, a peripheral edge of the lens LE held by the lens chucks 102R, 102L is roughened by the roughening grindstone 162*a* and thereafter, finished by the finishing grindstone 162*b*. When beveling is set, beveling is carried out based on an edge path position shape of the lens and bevel-finishing is carried out. Further, when grooving is set, a peripheral edge of the lens LE is finished to plane, thereafter, grooving is carried out by the boring/grooving mechanism portion 190. When boring is designated, a peripheral edge of the lens LE is finished to plane, thereafter, boring is carried out by the boring/grooving mechanism portion 190 (refer to, for example, U.S. Pat. No. 6,790,124 (JP-A-2003-145328)).

According to the above-described embodiments, the information written to the IC tag 42 is not limited to the left or right identifying information and the operation number. When a storage capacity of the IC chip provided to the IC tag 42 is large, data necessary for processing including the target lens shape data and the layout data inputted by the display 3 constituting a data inputting device may be written to be stored by the writing/reading unit 41. In this case, the writing/reading unit 41 transmits the target lens shape data and the layout data inputted by the display 3 along with the left or right identifying information to be stored to the IC tag 42. Or, based on selection of left or right by the left and right selecting keys 63R, 63L, the target lens shape data and the layout data of the left side or the right side selected are transmitted to be stored to the IC tag 42. The control portion 250 on the side of the processing device 200 sets left or right of the lens to be worked based on the left or right identifying information read by the reading unit 230 and sets the target lens shape data and the layout data read simultaneously. Thereby, the cup attaching device 1 and the processing device 200 can be used by being separated from each other without providing data transmitting means.

Further, the information stored to the IC tag 42 may be constituted only by the left or right identifying information. In this case, necessary data of the target lens shape data and the layout data and the like is acquired from the cup attaching device 1 by inputting the operation number to the operation number display column 212 on the side of the processing device 200 similar to the related art. Or, the side of the processing device 200 is provided with a data inputting device for inputting the target lens shape data and the layout data to be set thereby.

Furthermore, the IC tag 42 provided to the cup 25 can also be used by previously storing only the left or right identifying information. In this case, the cup 25 is attached with identifying information for the right eye and for the left eye by difference in colors to enable the operator to confirm by viewing the identifying information. Further, when the cup 25 is attached to the lens for the left eye by the cup attaching device 1, the cup having the IC tag 42 stored with the identifying information for the left is attached. Further, by making the reading unit 230 provided to the processing device 200 read the left or right identifying information of the IC tag 42 of the cup 25, the control portion 250 automatically sets left or right selection of the lens at the processing device 200. Further, information of selecting either of the left and right eyes is displayed on the display 210 as described above. Also thereby, a mistake of left or right is alleviated in processing.

What is claimed is:

1. An eyeglass lens processing system for processing a peripheral edge of each of left and right eyeglass lenses, the system comprising:

a data inputting device that inputs left and right target lens shape data and left and right layout data;

a memory that stores the input left and right target lens shape data and the input left and right layout data a lens fixing cup;

a cup attaching device that attaches the cup to the lens which is placed on a lens table; and an eyeglass lens processing device that holds the cup-attached lens by a lens chuck and processes the held lens, the cup having a rewritable IC tag, the cup attaching device including an inputting unit that inputs left or right identifying information of the left or right lens to which the cup is attached, and a writing device that writes the input left or right identifying information to the IC tag of the attached cup, and the eyeglass lens processing device including a reading device that reads the left or right identifying information written to the IC tag, and a setting unit that sets or displays the input left or right target lens shape data and the input left or right layout data as left or right processing information to be used for processing the left or right lens based on the read left or right identifying information.

2. The eyeglass lens processing system according to claim 1, wherein the inputting unit inputs the left or right identifying information and an operation number, and the writing device writes the input left or right identifying information and the input operation number to the IC tag of the attached cup.

3. The eyeglass lens processing system according to claim 2, wherein the reading device reads the left or right identifying information and the operation number written to the IC tag, and the setting unit sets the input left or right target lens shape data and the input left or right layout data as the left or right processing information based on the read left or right identifying information and the read operation number.

4. The eyeglass lens processing system according to claim 1, wherein the writing device writes the input left or right identifying information and the input left or right target lens shape data and the input left or right layout data as the left or right processing information to the IC tag of the attached cup.

5. The eyeglass lens processing system according to claim 1, wherein the cup attaching device further includes an outputting unit that outputs an instruction signal of writing the input left or right identifying information to the IC tag by the writing device based on a signal for carrying out attachment of the cup to the lens.

6. The eyeglass lens processing system according to claim 1, wherein the cup attaching device further includes a confirming unit that confirms whether or not the data written to the IC tag is abnormal, and a prohibiting unit that prohibits attachment of the cup to the lens when the data written to the IC tag is abnormal.

7. The eyeglass lens processing system according to claim 1, wherein the IC tag is shielded to be embedded in a base portion of the cup.

8. An eyeglass lens processing system for processing a peripheral edge of an eyeglass lens, the system comprising:

a data inputting device that inputs left and right target lens shape data and left and right layout data;

a cup attaching device that attaches a lens fixing cup used for processing the eyeglass lens, the cup including an IC tag capable of rewriting data, the cup attaching device including a left/right information inputting unit that inputs which of left or right eyeglass lens the cup-attached eyeglass lens is, and a writing device that writes processing information including the left/right identifying information to the IC tag; and an eyeglass lens processing device that holds the eyeglass lens by a lens chuck and processes the peripheral edge of the lens, the eyeglass lens processing device including a reading device that reads the left/right identifying information stored to the IC tag and a setting unit that sets the processing information based on the read left/right identifying information;

wherein the cup attaching device outputs an instruction signal of writing data based on a switch signal for carrying out attaching the cup.

9. An eyeglass lens processing system for processing a peripheral edge of an eyeglass lens, the system comprising:

a data inputting device that inputs left and right target lens shape data and left and right layout data;

a cup attaching device that attaches a lens fixing cup used for processing the eyeglass lens, the cup including an IC tag capable of rewriting data, the cup attaching device including a left/right information inputting unit that inputs which of left or right eyeglass lens the cup-attached eyeglass lens is, and a writing device that writes processing information including the left/right identifying information to the IC tag; and an eyeglass lens processing device that holds the eyeglass lens by a lens chuck and processes the peripheral edge of the lens, the eyeglass lens processing device including a reading device that reads the left/right identifying information stored to the IC tag and a setting unit that sets the processing information based on the read left/right identifying information;

wherein the cup attaching device further includes a reading device that reads data of the IC tag, and includes a confirming unit that confirms whether data written to the IC tag by the writing device and the data of the IC tag read by the reading device coincide with each other.

* * * * *